US009518383B2

(12) United States Patent
Lesmeister

(10) Patent No.: US 9,518,383 B2
(45) Date of Patent: Dec. 13, 2016

(54) BATHTUB DRAIN STOPPER ASSEMBLY AND SCREEN

(71) Applicant: John Lesmeister, Bartlett, IL (US)

(72) Inventor: John Lesmeister, Bartlett, IL (US)

(73) Assignees: John Lesmeister, Bartlett, IL (US); Charles Siegerdt, Roselle, IL (US)

( * ) Notice: Subject to any disclaimer, the term of this patent is extended or adjusted under 35 U.S.C. 154(b) by 170 days.

(21) Appl. No.: 14/538,901

(22) Filed: Nov. 12, 2014

(65) Prior Publication Data

US 2016/0130793 A1 May 12, 2016

(51) Int. Cl.
*A47K 1/14* (2006.01)
*E03C 1/264* (2006.01)

(52) U.S. Cl.
CPC *E03C 1/264* (2013.01); *A47K 1/14* (2013.01)

(58) Field of Classification Search
CPC ..... E03C 1/26; E03C 1/262; E03C 1/264
USPC ..... 4/286, 287, 295
See application file for complete search history.

(56) References Cited

U.S. PATENT DOCUMENTS 1,720,149 A * 7/1929 Rom ..... A47K 1/14 4/287
2,021,410 A 11/1935 Foose
3,220,695 A 11/1965 Downey
3,333,815 A 8/1967 Downey
3,426,295 A 2/1969 Downey
3,742,524 A 7/1973 Ballentine
3,959,831 A 6/1976 Hendricks
3,995,333 A 12/1976 Stephens
4,134,162 A 1/1979 Sharland
4,276,662 A 7/1981 Young
4,369,531 A 1/1983 Swanson
4,825,477 A 5/1989 Aranda
D316,594 S 4/1991 Yuen
5,271,108 A 12/1993 Wicke
5,297,299 A 3/1994 Wilson
D357,306 S 4/1995 Lenox
5,915,847 A 6/1999 Spears
6,067,669 A * 5/2000 Peterson ..... E03C 1/262 4/287
6,088,842 A 7/2000 Barnett
6,138,290 A * 10/2000 Lin ..... E03C 1/22 4/286
6,195,819 B1 3/2001 Wang
6,226,806 B1 5/2001 Ball
6,237,168 B1 5/2001 Daniel
D450,106 S 11/2001 Herr
6,363,544 B1 * 4/2002 Ryan ..... A47K 1/14 4/287
6,418,570 B1 7/2002 Ball
D462,422 S 9/2002 Conner
6,487,729 B2 12/2002 Delanzo
6,691,411 B2 2/2004 Ball
6,880,179 B2 4/2005 Wang
(Continued)

*Primary Examiner* — Huyen Le
(74) *Attorney, Agent, or Firm* — Michael P. Mazza, LLC

(57) ABSTRACT

A drain stopper assembly for a bathtub having a drain aperture, and a method for using the assembly. A guide rod may be slid within a guide slide, allowing a gasket to be sealed or unsealed against the drain aperture. Magnets or, alternatively, a spring-loaded mechanism, may be used to facilitate sealing/unsealing of the gasket. A filter may be mounted within the drain aperture, and be removably or permanently attached to the assembly.

17 Claims, 3 Drawing Sheets

(56) References Cited

U.S. PATENT DOCUMENTS

| | | | | |
|---|---|---|---|---|
| 6,938,279 | B1 | 9/2005 | Henderson | |
| 7,013,500 | B1 | 3/2006 | Lin | |
| 7,032,254 | B1 | 4/2006 | Dong | |
| 7,150,576 | B1 | 12/2006 | Kambeyanda | |
| 7,178,179 | B2 | 2/2007 | Barnes | |
| 7,376,983 | B1 | 5/2008 | Sciarrino | |
| D605,733 | S | 12/2009 | Cavalieri | |
| 7,704,386 | B2 | 4/2010 | Ventura | |
| 7,736,499 | B2 | 6/2010 | Chong | |
| 7,887,697 | B2 | 2/2011 | Worth | |
| 8,146,616 | B2 | 4/2012 | Dallmer | |
| D672,438 | S | 12/2012 | Huguens | |
| 9,060,656 | B2 * | 6/2015 | Tong | A47K 1/14 |
| 2002/0144338 | A1 | 10/2002 | Delanzo | |
| 2005/0223481 | A1 | 10/2005 | Giacomi | |
| 2006/0248637 | A1 * | 11/2006 | Pan | E03C 1/2306 4/295 |
| 2008/0178382 | A1 | 7/2008 | Pinette | |
| 2008/0230469 | A1 | 9/2008 | Cherveny | |

* cited by examiner

BATHTUB DRAIN STOPPER ASSEMBLY AND SCREEN

BACKGROUND OF THE INVENTION

The present invention generally relates to drain plugs for bathtubs.

Bathtub drains include a "tub shoe" providing a drain aperture located at a low slope in the bathtub. The drain aperture may be formed by an upper portion of a metallic drain fitting designed to connect with a pipe that takes waste water from the bathtub. A drain stopper may be used to plug the drain aperture while the bathtub is in use.

Drop-in screens have also been used to prevent solid detritus (hair, clippings, etc.) from clogging the drain. There are disadvantages to the use of such screens. For example, the screen and plug may not be sized to fit together, and use of the screen can cause the plug to be lost. Also, the screen can loosen during use and float, allowing detritus to clog the drain. Such devices may also not provide the stock appearance of bathtub drain plugs. Additionally, it may not be possible to fill the bathtub unless the screen and drain plug are re-installed, which can be difficult, particularly if the bathtub is already partially filled with water.

Conventional screens for bathtub drains can also be difficult to clean/unclog, as many have more apertures in the screen than are necessary given the flow of water passing through the screen, or the screen may have a relatively large circumference, such that it is time-consuming to remove hair from it, for example.

Conventional drain plugs include rubber seals/plugs that simply press-fit into the drain aperture, and can easily loosen during use. Unless only an elastomeric plug is used, conventional drain plugs may require a fixed (threaded) connection with the drain opening, such as drain plugs that are rotated into a sealing connection using a lift-and-turn movement, which can be cumbersome and/or tricky to seal in place and to unseal. "Pop and seal" (e.g., spring-loaded) drain plugs have also been used, with similar problems. Such drain plugs are also typically fixed to the screen, allowing hair to wrap around the screen, which can be time-consuming to remove.

SUMMARY OF THE INVENTION

The objects mentioned above, as well as other objects, are solved by the present invention, which overcomes disadvantages of prior screens and drain plugs for bathtubs, while providing new advantages not previously associated with them.

The present invention includes a bathtub drain stopper assembly with a built-in screen which is removable from the stopper assembly for ease in cleaning. The stopper and screen are drop-in ready and easy to use, and assume use by a consumer with no plumbing experience. In appearance, the invention also provides, when installed, a stock appearance.

In a preferred embodiment of the invention, a drain stopper assembly for a bathtub having a drain aperture is provided, having a top cover, a gasket, a guide slide attached to the top cover, and a guide rod with proximal and distal ends, capable of sliding within the guide slide. A plurality of magnets may also be provided, including at least a first magnet located at the proximal end of the guide rod, and a second magnet located in the guide slide. Alternatively, instead of or in addition to magnets, a spring-loaded assembly may be used. When downward pressure is applied to the top cover, the gasket is enabled to seal against the drain aperture, and the guide rod slides upwardly within the guide slide to a second position; the guide rod may be facilitated in being maintained in the second position by the first and second magnets.

The guide slide may be removably attached to the top cover, and the gasket may be mounted to the guide slide. The top cover may include a knurled gripping surface. The guide rod may be integral with the slide guide, or may be removably attached to the slide guide.

A collecting filter may be provided which is removably attached to the distal end of the guide rod. The filter may be a cylindrical screen with a plurality of apertures located on a sidewall and a bottom surface of the screen. A third magnet may be located at the distal end of the guide rod, attracted to the collecting filter.

In an alternative embodiment, the distal end of the guide rod may include a finger useful for removing hair from the filter basket. The magnets may be encased by a protective coating. The top cover may be attached to the guide slide using a threaded connection. The collecting filter may include an upwardly facing nub, and the distal end of the guide rod may include an aperture sized to fit over the nub.

A method of providing a drain stopper assembly for a bathtub having a drain aperture, also forms a part of the present invention. The method includes providing a top cover, a gasket, a guide slide attached to the top cover, a gasket capable of being sealed to and unsealed from the drain aperture, and a guide rod having proximal and distal ends, wherein the guide rod slides within the guide slide. Pushing down on the top cover causes the guide rod to slide relative to the guide slide, enabling the gasket to be sealed against the drain aperture. Raising the top cover causes the guide rod to slide relative to the guide slide, enabling the gasket to be unsealed from the drain aperture. Magnetic or spring-loaded means may be used to facilitate the sealing and unsealing of the gasket relative to the drain aperture. A filter may be mounted within the drain aperture.

DEFINITION OF CLAIM TERMS

The terms used in the claims of the patent are intended to have their broadest meaning consistent with the requirements of law. Where alternative meanings are possible, the broadest meaning is intended. All words used in the claims are intended to be used in the normal, customary usage of grammar and the English language.

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Figure 1:
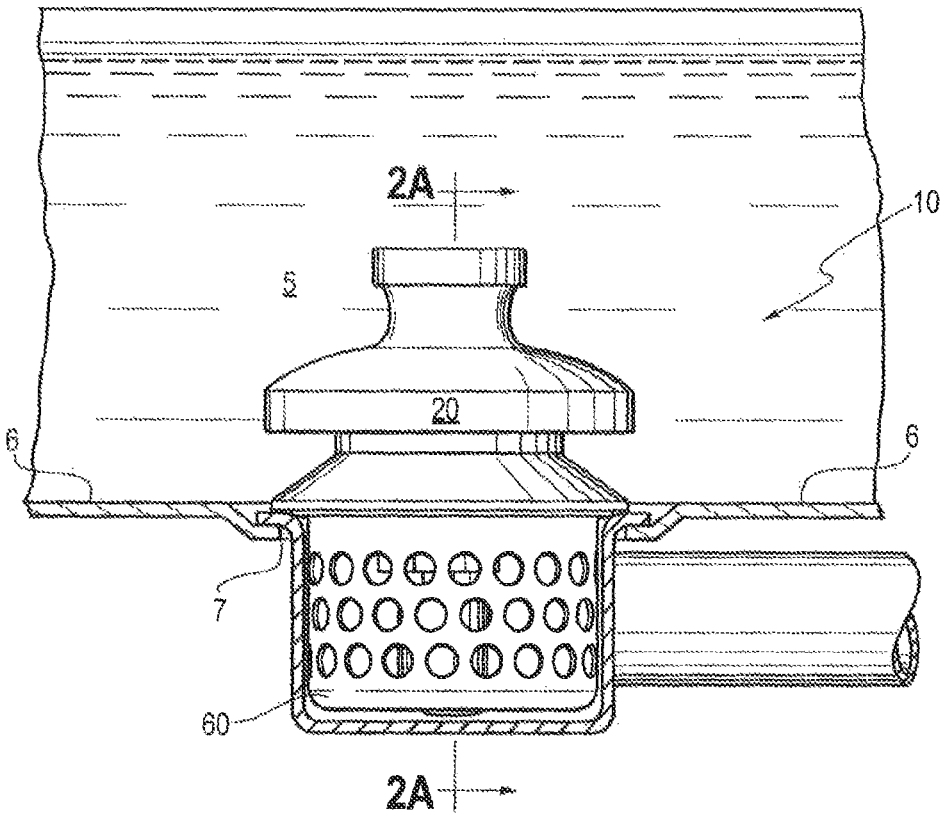
FIG. 1 is a partial side perspective view of a portion of a bathtub and drain aperture, and a preferred embodiment of the drain plug assembly of the invention.

Referring first to FIG. 1, a bathtub 5 includes a bottom surface 6 with a drain aperture 7 into which drain plug assembly 10 of the present invention may be inserted.

Referring now to FIGS. 1-4, drain plug assembly 10 may generally include a top cover 20, a guide slide 40 attached to the top cover, a guide rod 50 attached or integral with guide slide 40, and a filter basket 60.

Top cover 20 may include a top portion 20*a* and a bottom portion 20*b*, as shown. (Alternatively, cover 20 may consist of a single cylindrical-shaped portion 20*b* as is more conventional.) Top portion 20*a* may have a smaller diameter and have knurled side surfaces 21, for easier gripping. (Top portion 20*a* need not be used, and only bottom portion 20*b* may be used, if desired.) Bottom portion 20*b* may include a cylindrical ring 23 with male/female threads 24 designed to mate with corresponding female/male threads 41 on guide slide 40 (see FIG. 3). Gasket 30, which may be made of rubber or another suitable material, may include an inner ring surface 31 sized to fit over guide slide threads 41, and may be fixed in place adjacent guide slide shelf 42, between the guide slide and top cover, when the guide slide and the top cover are threadably attached. (Alternatively, the inner surface of ring 23 of top cover 20 may be connected in a frictional press-fit manner to the outer surface of the upper portion 40*a* of guide slide 40, obviating the need for threads 24 and 41.) Gasket 30 is designed to provide a water-resistant seal over drain aperture 7 when drain plug assembly 10 is inserted into the drain aperture.

In the preferred embodiment, while the upper portion 40*a* of guide slide 40 may be removably attached to cover 20, the lower portion 40*b* of the guide slide may be adapted to allow guide rod 50 to slide within the guide slide. For this purpose, a retaining clip 50*b* with any suitable cross-section may be used to press-fit into and cover the upper opening of guide slide 40, covering magnet 72. The guide rod 50 may be permitted to slide within guide slide 40, but is preferably prevented from dropping out of the guide slide (and thus potentially being lost down the drain opening), such as by forming channel 83 with step 83*a*, such that the upper end of guide rod 50 with retaining clip 50*b* will catch on step 83*a*.

Figure 4:
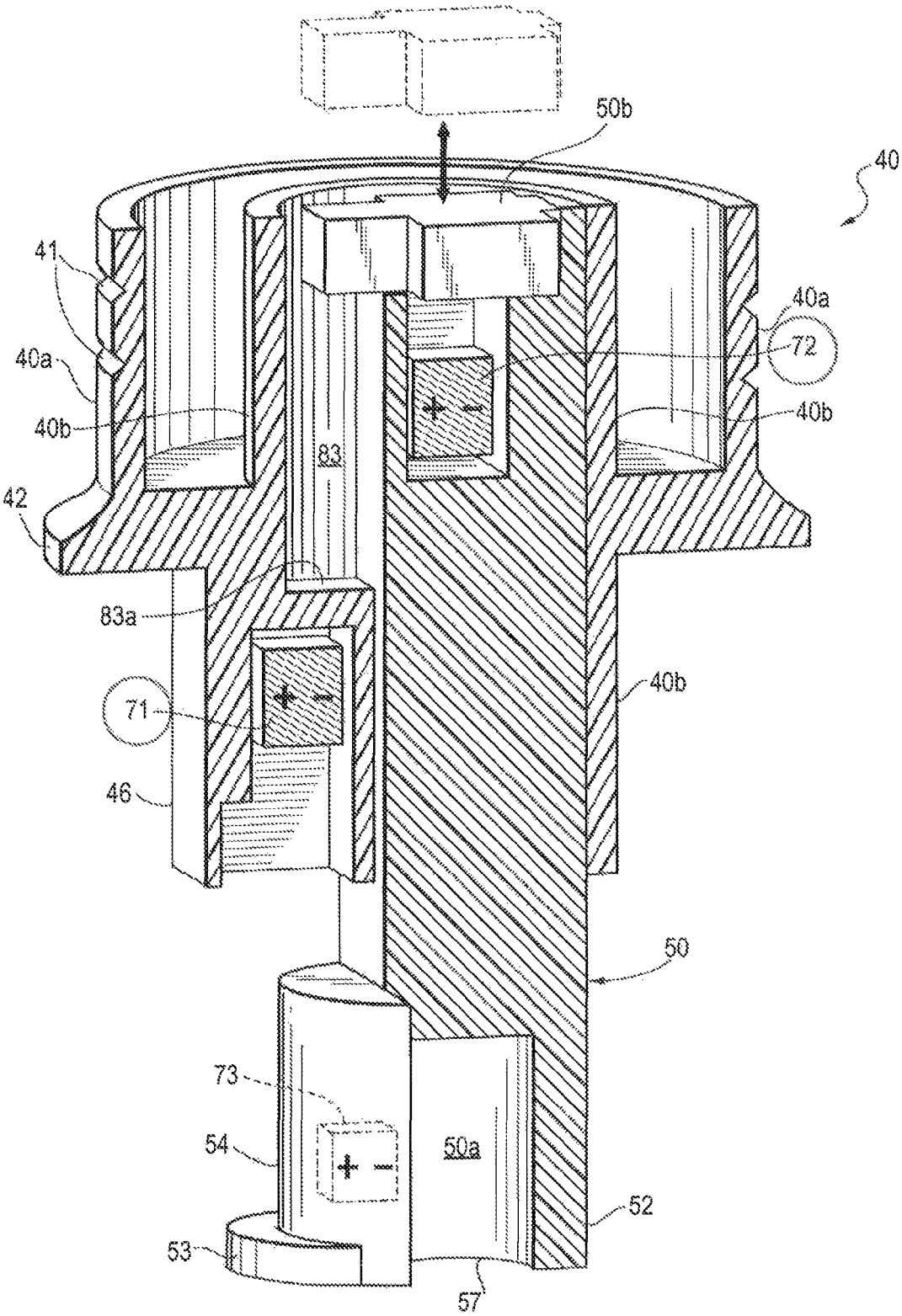
FIG. 4 is a sectional view along reference line 4-4 of FIG. 3, showing the guide slide and guide rod of the preferred drain plug assembly.

Guide slide 40 may be made with a single thick wall. However, as shown in FIG. 4, it may be preferred to fabricate guide slide 40 with opposing inner 40*b* and outer 40*a* walls, to use less material and to allow for more rapid fabrication in an injection mold process, for example.

While in the preferred embodiment, the guide rod slides within the guide slide, those of ordinary skill in the art will appreciate that the guide rod could be configured so that it has a hollow shell that slides outside of the outer surface of the guide slide.

In the preferred embodiment, to facilitate providing the drain plug assembly in compressed, plugging (FIG. 2*a*) and raised, unplugged (FIG. 2*b*) positions, magnets may be used. Here, magnet 71 may be provided in guide slide 40, such as within guide slide protuberance 46, and magnet 72 may be provided at a proximal (upper) end of guide rod 50 (see FIG. 4). By insuring that these magnets, when located in proximity, attract each other, they will cause the drain plug assembly to be induced to, and/or remain in, the raised, unplugged position when that position is desired. Additionally, magnet 73 may be provided in a distal end protuberance 54 of the guide rod, insuring by its attraction to metal filter basket 60, that the drain plug assembly will be induced to, and/or remain in, the compressed, plugging position when that position is desired. Magnet 73 need not be used, however, as the distal end 52 of guide rod 50 may be designed to have a press-fit connection to nub 64.

Preferably, the magnets may be provided in a protective plastic, water-resistant sleeve, for example, so that they are not visible and they are not exposed to potential rust-inducing agents such as air and water.

Figure 3:
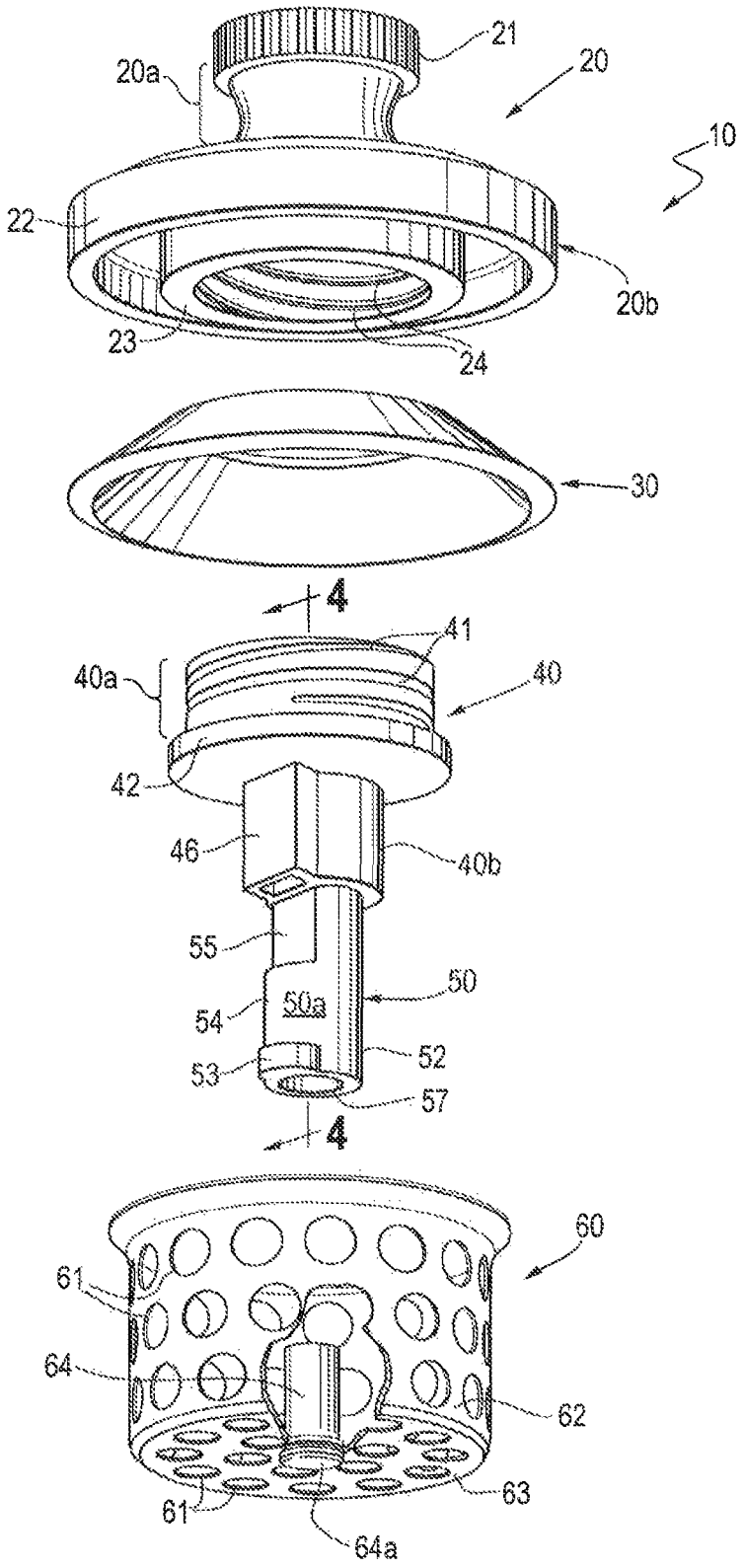
FIG. 3 is a perspective view showing the components of the drain plug assembly.

Filter basket 60 is preferably made of a magnetized metal to insure attraction to magnet 73. Filter basket may include apertures 71 on sidewalls 72 and bottom wall 63, preferably roughly evenly-spaced and sized as shown, to catch objects which may clog the drain, such as hair and other detritus, while allowing water and smaller particles such as dirt which will not clog the drain to pass through the screen. An upwardly-standing locating nub 64 may be located on the upper surface of bottom wall 63, for receiving a like-sized aperture 57 at the bottom of guide rod 50, providing a frictional engagement that facilitates the user's proper location and attachment of the guide rod to the screen. Nub 64 may be a separate attachment or may be integrally made with filter basket 60. Referring to FIG. 3, the distal end of nub 64 that protrudes from the lower end of the basket may terminate in a small dimple or raised area 64*a*. If nub 64 is integrally made with the basket, this obviates the need for dimple 64*a*.

Accordingly, it will be appreciated that a drop-in-ready bathtub drain stopper is provided, with a built-in screen that is removable for cleaning of the filter basket. The device is easy to use with the consumer in mind, and requires no prior plumbing experience. The device of the present invention also does not sacrifice in appearance, as when installed it can still provide the bathtub with a conventional appearance. The invention also preferably provides magnetic technology for the drain-and-fill feature, which is easy to use and glides smooth.

It will also be appreciated that the bathtub drain plug assembly of the present invention need not be fixed to any other fixture or fixed object, and is easy to use. To plug the tub, the user simply pushes down on the top cover, causing the magnet at the distal end of the guide rod to be attracted to the filter basket, allowing gravity to keep the top cover down in the plugged/lowered position shown in FIG. 2*a*, and inducing a water-resistant seal between the gasket and the upper bathtub surface 6 around drain aperture 7. (As water fills the tub, this water-head pressure acts as an additional force tending to seal the gasket down against the bathtub bottom wall surface, insuring a water-tight seal.)

Figure 2A:
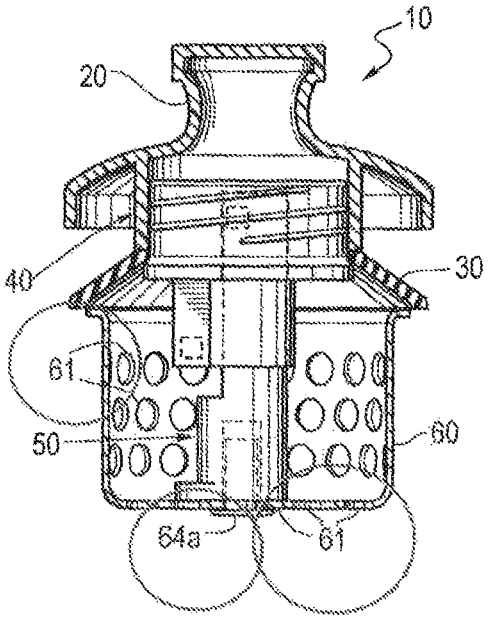
FIGS. 2*a* and 2*b* are partial sectional views of the drain plug assembly taken along reference line 2*a*-2*a* of FIG. 1, showing the drain plug assembly in compressed and raised positions, respectively.
Figure 2B:
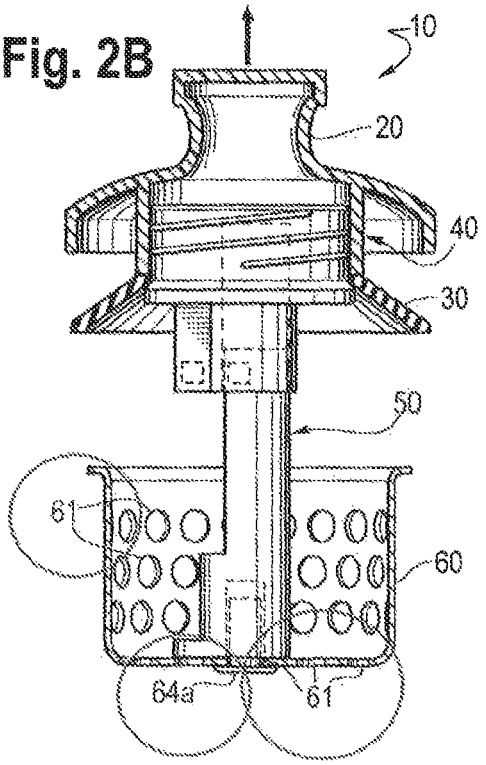

To drain the tub, the user simply pulls up on the top cover, releasing the gasket and causing magnets 71, 72 to be located within their respective magnetic fields, causing the drain plug assembly to remain in the raised/open position shown in FIG. 2*b*.

The top portion of the drain plug assembly is easily separated from the filter basket for easy cleaning. First, the user may simply grab hold of the top cover and lift the entire device out of the drain hole. Next, the basket and top portion of the drain plug assembly can be easily separated by pulling in opposite directions. Preferably, to insure the force required to remove the entire assembly 10 from drain aperture 7 less than the force required to separate the upper half of assembly 10 from filter basket 60, aperture 57 on the distal end of guide rod 50 and upstanding nub 64 on basket 60 are precision-machined male and female ends that slide into each other with a tight tolerance, providing a frictional connection that will hold in place when desired, but will easily separate when pulled apart by a user, as needed.

Referring to FIG. 3, protuberance 53 located at the distal end of guide rod 50 may be provided, and acts like a hook or finger to allow the user to easily clean the basket by swiping out hair in the basket, for example.

Persons of ordinary skill in the art will appreciate that the invention may be made of various metal and/or plastic materials. For example, top cover 20 may be made of chrome, brushed nickel, stainless steel, or other materials. "Economy" (all plastic) or "luxury" (all stainless steel and brass) models of the drain plug assembly may be provided, if desired. Color choices for the top may include oil-rub bronze, gold, silver or other colors. The guide slide and guide rod may be made of plastic, for example, or from a metal, if desired.

Use of the present invention will save on the use expensive plumbers to unclog bathtub drains, and also reduce or eliminate the use of drain-cleaning chemicals that may be harmful to the environment and/or toxic to breathe and contact with the skin or eyes.

The above description is not intended to limit the meaning of the words used in the following claims that define the invention. Persons of ordinary skill in the art will understand that a variety of other designs still falling within the scope of the following claims may be envisioned and used. For example, while preferred embodiments involving a top cover threadably attached to a guide slide have been disclosed, in other embodiments the top cover could be frictionally press-fit to the guide slide. Also, while the filter basket has been disclosed as removably engaged to the slide rod, it could be permanently attached instead. It is contemplated that these additional examples, as well as future modifications in structure, function, or result to that disclosed here, will exist that are not substantial changes to what is claimed here, and that all such insubstantial changes in what is claimed are intended to be covered by the claims.

I claim:

1. A drain stopper assembly for a bathtub having a drain aperture, the drain stopper assembly capable of being placed in uncompressed and compressed positions, comprising:

a top cover;

a gasket;

a guide slide attached to the top cover;

a guide rod having proximal and distal ends, the guide rod being capable of sliding within the guide slide; and a plurality of magnets including at least a first magnet located at the proximal end of the guide rod, and a second magnet located in the guide slide;

wherein when downward pressure is applied to the top cover, the gasket is enabled to seal against the drain aperture, as the guide slide slides downwardly on the guide rod to a compressed, second position; and when the downward pressure to the top cover is released, and the guide slide is permitted to slide upwardly relative to the guide rod so that the drain stopper assembly is in the uncompressed position, the drain stopper assembly is facilitated in being maintained in the uncompressed position by a proximity of the first and second magnets.

2. The drain stopper assembly of claim 1, wherein the guide slide is removably attached to the top cover, and the gasket is mounted to the guide slide.

3. The drain stopper assembly of claim 1, wherein the top cover includes a knurled gripping surface.

4. The drain stopper assembly of claim 1, wherein the guide rod is integral with the slide guide.

5. The drain stopper assembly of claim 1, wherein the guide rod is removably attached to the slide guide.

6. The drain stopper assembly of claim 1, further comprising a collecting filter removably attached to the distal end of the guide rod.

7. The drain stopper assembly of claim 6, wherein the collecting filter comprises a cylindrical screen with a plurality of apertures located on a sidewall and a bottom surface of the screen.

8. The drain stopper assembly of claim 6, further comprising a third magnet located adjacent a the distal end of the guide rod, attracted to the collecting filter.

9. The drain stopper assembly of claim 6, wherein the distal end of the guide rod includes a finger useful for removing hair from the filter basket.

10. The drain stopper assembly of claim 6, wherein the collecting filter includes an upwardly facing nub, and the distal end of the guide rod includes an aperture sized to fit over the nub.

11. The drain stopper assembly of claim 1, wherein the first and second magnets are encased by a protective coating.

12. The drain stopper assembly of claim 1, wherein the top cover attaches to the guide slide using a threaded connection.

13. A drain stopper assembly for a bathtub having a drain aperture, comprising:

a top cover;

a guide slide attached to the top cover;

a gasket capable of being sealed to and unsealed from the drain aperture; and a guide rod having proximal and distal ends; the guide rod sliding within the guide slide;

wherein pushing down on the top cover causes the guide rod to slide relative to the guide slide, enabling the gasket to be sealed against the drain aperture; and means for facilitating sealing of the gasket to, and unsealing the gasket from, the drain aperture, comprising a plurality of magnets.

14. The drain stopper assembly of claim 13, further comprising a filter mounted at least partially within the drain aperture, and removably attached to the guide rod.

15. A drain stopper assembly adapted for drop-fit connection to a drain aperture of a bathtub, comprising:

a manually-graspable top cover;

a gasket adapted for movement between a sealed engagement position to, and an unsealed engagement from, the drain aperture;

a guide slide attached to the top cover;

a guide rod having proximal and distal ends, the guide rod being capable of sliding relative to the guide slide, to thereby move the gasket between the sealed and unsealed engagement positions; and a filter basket removably engaged to the guide rod;

whereby the drain stopper assembly may be drop-fit into the drain aperture, such that the filter basket is at least partially enclosed by the drain aperture, and wherein when only downward pressure is applied to the top cover, the gasket is enabled to seal against the drain aperture, and further comprising a plurality of magnets for facilitating the positioning of the gasket between the sealed and unsealed engagement positions.

16. A method of providing a drain stopper assembly for a bathtub having a drain aperture, capable of being used with the following steps:

providing a top cover, a gasket, a guide slide attached to the top cover, a gasket capable of being sealed to and unsealed from the drain aperture, and a guide rod having proximal and distal ends, wherein the guide rod slides within the guide slide;

pushing down on the top cover, causing the guide rod to slide relative to the guide slide, and thereby enabling the gasket to be sealed against the drain aperture; and raising the top cover, again causing the guide rod to slide relative to the guide slide, and thereby enabling the gasket to be unsealed from the drain aperture; and facilitating the sealing and unsealing of the gasket relative to the drain aperture using magnetic means.

17. The method of claim 16, further comprising a filter mounted within the drain aperture.

* * * * *